US010247427B2

(12) United States Patent
Deivasigamani et al.

(10) Patent No.: US 10,247,427 B2
(45) Date of Patent: Apr. 2, 2019

(54) MULTI-TEMPERATURE OUTPUT FLUID HEATING SYSTEM

(71) Applicants: Sridhar Deivasigamani, Peoria, IL (US); Sivaprasad Akasam, Dunlap, IL (US)

(72) Inventors: Sridhar Deivasigamani, Peoria, IL (US); Sivaprasad Akasam, Dunlap, IL (US)

(73) Assignee: Intellihot, Inc., Galesburg, IL (US)

( * ) Notice: Subject to any disclaimer, the term of this patent is extended or adjusted under 35 U.S.C. 154(b) by 185 days.

(21) Appl. No.: 15/596,089

(22) Filed: May 16, 2017

(65) Prior Publication Data

US 2017/0248325 A1 Aug. 31, 2017

Related U.S. Application Data

(62) Division of application No. 14/602,248, filed on Jan. 21, 2015, now Pat. No. 9,719,687.

(Continued)

(51) Int. Cl.
*F24D 19/10* (2006.01)
*F24D 3/08* (2006.01)

(Continued)

(52) U.S. Cl.
CPC ..... *F24D 19/1069* (2013.01); *F24D 3/08* (2013.01); *F24D 3/082* (2013.01); *F24H 1/08* (2013.01);

(Continued)

(58) Field of Classification Search
CPC ..... F24D 3/08; F24D 3/082; F24D 19/1069; F24D 2220/044; F24D 2220/042;

(Continued)

(56) References Cited

U.S. PATENT DOCUMENTS 1,112,583 A * 10/1914 Williams ..... F24H 1/48 122/20 A
2,781,174 A * 2/1957 Smith ..... F24D 3/08 122/15.1

(Continued)

FOREIGN PATENT DOCUMENTS

DE 3244373 A1 * 6/1983 ..... F24D 9/00
DE 3828396 A1 * 3/1989 ..... F24D 3/08

(Continued)

*Primary Examiner* — Gregory L Huson
*Assistant Examiner* — Daniel E Namay
(74) *Attorney, Agent, or Firm* — Tracy Jong Law Firm; Tracy P. Jong; Cheng Ning Jong

(57) ABSTRACT

A multi-temperature output fluid heating system including an input for receiving a fluid supply, a single heating source, a first output, a second output and a bypass path. The first output is fluidly connected to the input, where the first output is adapted for control by a first control device and to receive heat from the single heating source to achieve a first temperature at the first output. The bypass path fluidly connects the input and the second output. The input is adapted to empty a first portion of the fluid supply into the first output and a second portion of the input into the bypass path. The second output is adapted to receive an output from the first output and an output from the bypass path to achieve a second temperature.

4 Claims, 6 Drawing Sheets

Related U.S. Application Data

(60) Provisional application No. 61/929,535, filed on Jan. 21, 2014.

(51) Int. Cl.
*F24H 1/08* (2006.01)
*F24H 1/12* (2006.01)
*F24H 1/48* (2006.01)
*F24H 1/52* (2006.01)

(52) U.S. Cl.
CPC ..... *F24H 1/125* (2013.01); *F24H 1/48* (2013.01); *F24H 1/52* (2013.01); *F24D 2220/042* (2013.01); *F24D 2220/044* (2013.01); *F24D 2220/08* (2013.01)

(58) Field of Classification Search
CPC ..... F24D 2220/08; F24H 1/125; F24H 1/08; F24H 1/122; F24H 1/48; F24H 1/50; F24H 1/52
USPC ..... 237/2 A, 8 D, 8 A, 63, 61, 8 C, 19; 122/13.01–19.1; 165/81, 183, 184
See application file for complete search history.

(56) References Cited

U.S. PATENT DOCUMENTS 4,511,790 A * 4/1985 Kozak ..... F24H 9/2014 219/483
4,798,240 A * 1/1989 Gerstmann ..... F24D 3/08 165/48.1
4,824,014 A * 4/1989 Stuch ..... G05D 23/1931 236/91 F
5,051,562 A * 9/1991 Bailey ..... A61F 7/0085 219/483
5,128,517 A * 7/1992 Bailey ..... A61F 7/0085 219/490
5,332,884 A * 7/1994 Bailey ..... G05D 23/1919 219/212
6,462,313 B1 * 10/2002 Sandhu ..... H01L 21/67248 219/121.43
7,322,532 B2 * 1/2008 Takada ..... F24H 9/2035 122/14.2
7,532,982 B2 * 5/2009 Inoue ..... F24H 1/52 702/3
7,712,677 B1 * 5/2010 Munsterhuis ..... F24H 1/206 122/14.22
8,461,493 B1 * 6/2013 Cantolino ..... H05B 1/0283 219/494
8,910,880 B2 * 12/2014 Farrell ..... F24D 3/08 122/15.1
8,971,694 B2 * 3/2015 Deivasigamani ..... G06F 17/30902 122/14.1
9,182,159 B2 * 11/2015 Hatada ..... F25B 27/00
9,500,376 B2 * 11/2016 Minamisako ..... F24D 11/0214
9,719,687 B2 * 8/2017 Deivasigamani ... F24D 19/1069
2005/0004712 A1 * 1/2005 Stevens ..... G05D 23/1393 700/266
2006/0026974 A1 * 2/2006 Takada ..... F24H 9/2035 62/150
2006/0173653 A1 * 8/2006 Chian ..... F24H 9/2007 702/182
2007/0034702 A1 * 2/2007 Rixen ..... B60H 1/2206 237/2 A
2007/0205292 A1 * 9/2007 Kwak ..... F23N 1/082 236/21 B
2008/0033651 A1 * 2/2008 Inoue ..... F24H 1/52 702/3
2009/0090310 A1 * 4/2009 Farrell ..... F24D 3/08 122/20 A
2009/0277203 A1 * 11/2009 Dupraz ..... F24D 3/08 62/238.7
2010/0004790 A1 * 1/2010 Harbin, III ..... F24D 19/1051 700/291
2010/0195991 A1 * 8/2010 Deivasigamani ... F24D 17/0026 392/308
2010/0236498 A1 * 9/2010 Komori ..... F24D 3/082 122/19.1
2010/0319378 A1 * 12/2010 Chikami ..... F24D 3/082 62/238.7
2010/0326646 A1 * 12/2010 Kim ..... F24D 17/0031 165/287
2010/0329650 A1 * 12/2010 Kim ..... F24D 17/0031 392/449
2011/0017152 A1 * 1/2011 Min ..... F24D 3/08 122/19.1
2011/0232862 A1 * 9/2011 Gofton ..... A47J 31/005 165/64
2012/0043390 A1 * 2/2012 Noh ..... F24D 3/08 237/2 A
2012/0090341 A1 * 4/2012 Hatada ..... F25B 27/00 62/238.7
2012/0090560 A1 * 4/2012 Iwama ..... F24H 1/145 122/14.3
2012/0091214 A1 * 4/2012 Rixen ..... F23N 3/08 237/5
2012/0291719 A1 * 11/2012 Steinhafel ..... F24H 1/00 122/18.3
2012/0305105 A1 * 12/2012 Min ..... F24D 3/087 137/337
2013/0193221 A1 * 8/2013 Buescher ..... F24H 9/2021 237/8 A
2013/0284116 A1 * 10/2013 Deivasigamani ... F24D 17/0026 122/14.21
2013/0284117 A1 * 10/2013 Deivasigamani ... F24D 17/0026 122/18.1
2014/0202680 A1 * 7/2014 Kusachi ..... F23N 1/082 165/287
2014/0229022 A1 * 8/2014 Deivasigamani .... G05D 7/0629 700/282
2014/0241708 A1 * 8/2014 Chaudhry ..... F24H 9/2021 392/454
2014/0343888 A1 * 11/2014 Bourke ..... F24D 11/003 702/136
2015/0014425 A1 * 1/2015 Olesen ..... F24D 3/08 237/8 C
2015/0159913 A1 * 6/2015 Yamamoto ..... F24H 1/18 122/14.21
2015/0204550 A1 * 7/2015 Deivasigamani ... F24D 19/1069 237/2 A
2016/0320075 A1 * 11/2016 Deivasigamani ... F24D 19/1066

FOREIGN PATENT DOCUMENTS

JP 05118652 A * 5/1993
JP 2014137206 A * 7/2014 ..... F23N 1/082

* cited by examiner

MULTI-TEMPERATURE OUTPUT FLUID HEATING SYSTEM

PRIORITY CLAIM AND RELATED APPLICATIONS

This divisional application claims the benefit of priority from non-provisional application U.S. Ser. No. 14/602,248 filed on Jan. 21, 2015 and provisional application U.S. Ser. No. 61/929,535 filed on Jan. 21, 2014. Said application is incorporated by reference in its entirety.

BACKGROUND OF THE INVENTION

1. The Field of the Invention

The present invention is directed generally to a multi-temperature output fluid heating system. More specifically, the present invention is directed to a temperature controlled domestic and space heating hot water combination unit.

2. Background Art

Domestic water heating is typically performed separately from floor or space heating as these two types of heating must meet two diverse sets of heating requirements. The target temperature for domestic water heating must be set at a suitable level so that scalding concerns are eliminated but yet sufficiently hot for domestic water needs, e.g., for showering, washing, etc. As the fluids or fluid conductors used in space heating loops do not typically come in direct contact with space heating users and therefore do not pose scalding concerns, the target temperature for a space heating system can be increased to a level much higher than that for domestic hot water needs. The need for two separate heating systems for both domestic water and space heating causes the need for additional physical spaces to accommodate the equipment of such systems and also duplicate control systems be made available for each system and maintenance of multiple systems instead of a single system. Recent advancements in space heating technologies have caused widespread use of floor heating systems utilizing heated tubes incorporated in floors or baseboards as compared to forced air heating systems where heat is brought into a space via the supply of warm air into the space.

Thus, there arises a need for a single heating system which can meet both the needs for domestic hot water and space heating.

SUMMARY OF THE INVENTION

Disclosed herein is a multi-temperature output fluid heating system including an input for receiving a fluid supply, a single heating source, a first output, a second output and a bypass path. The first output is fluidly connected to the input, where the first output is adapted for control by a first control device and to receive heat from the single heating source to achieve a first temperature at the first output. The bypass path fluidly connects the input and the second output. In one flow configuration, the input is adapted to empty a first portion of the fluid supply into the first output and a second portion of the fluid supply into the bypass path. The second output is adapted to receive an output from the first output and an output from the bypass path to achieve a second temperature.

The present system further includes a pump disposed upstream of the first output and configured for pushing an output of the first output through a heat exchanger.

In one embodiment, the heat exchanger is a plate-type heat exchanger.

In one embodiment, the first control device is a modulating device configured to modulate the first portion. In one example, the modulating device is a proportional valve.

In one embodiment, the second portion is adapted for control by a second control device. In one example, the second control device is an on-off valve, e.g., a solenoid valve. In another example, the second control device is a proportional valve.

In one embodiment, the second control device is a solenoid valve having a failed state configured to allow the second portion from the input to the second output.

In one embodiment, the present system further includes a temperature regulator disposed between the second output and the first output. The temperature regulator is configured to prevent overheating of the second output if the first output has been maintained for a long period of time at an unacceptably high level for the second output.

In one embodiment, the temperature regulator is an S-shaped bend. In another embodiment, the temperature regulator is a loop.

In one embodiment, the present system further includes a buffer tank disposed between the input and the first output.

In one embodiment, the present system further includes a temperature sensor disposed at the second output, wherein the temperature sensor is adapted to detect a condition where the second temperature that is unacceptably high.

In one example, the first temperature is controlled to about 180 degrees F. In another example, the first temperature is controlled to about 120 degrees F. In one example, the second temperature is controlled to about 120 degrees F. In one example, the first temperature is substantially the same as the second temperature.

Also disclosed herein is a method of adjusting the target temperature of a fluid heating system, the method including:

(a) obtaining a log of at least one event over a period of time;

(b) calculating a parameter of the at least one event over the period of time from the log;

(c) comparing the parameter to a pre-determined threshold, wherein if the parameter exceeds the pre-determined threshold, a difference between the parameter and the pre-determined threshold is calculated; and (d) applying the difference to the target temperature of the fluid heating system.

In one embodiment, the parameter is frequency. In an embodiment where the fluid heating system includes a space heating loop having a supply line and a return line, the parameter is the temperature of the return line. An event includes turn-on-off of the fluid heating system, turn-on of the fluid heating system, turn-off of the fluid heating system and duration of turn-on of the fluid heating system.

Accordingly, it is a primary object of the present invention to provide both domestic heated water at suitable temperature of about 120 degrees F. for domestic uses and at the same time, heated fluid for space heating temperature of about 180 degrees F. using only one heating source and one set of active, fluidly-connected fluid conductors to service both domestic water and space heating demands.

It is another object of the present invention to provide a passive means for isolating negative temperature effects of a first heating loop from a second heating loop that is fluidly connected to the first heating loop.

It is yet another object of the present invention to provide a means for anticipating the amount of required heating for the present heating system.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—domestic and space heating hot water combination unit
4—domestic water output
6—domestic water input
8—second control device or valve
10—temperature sensor
12—temperature regulator
14—first control device or flow adjustment valve
16—check valve
18—pump
20—buffer tank
22—heat exchanger where fluid flowing through it receives heat from a single heat source
24—heat exchanger, e.g., plate-type heat exchanger where the fluids in the conductors involved in heat transfer are not fluidly connected
26—return line of space heating
28—supply line of space heating
30—temperature regulating S-shaped bend
32—temperature regulating loop
34—height of temperature regulating S-shaped bend
36—height of temperature regulating loop
38—controller
40—juncture where heated water and cold water meet
42—temperature sensor disposed upstream of heat exchanger 22
44—temperature sensor disposed downstream of heat exchanger 22
46—bypass path
48—first output

PARTICULAR ADVANTAGES OF THE INVENTION

The present invention enables the use a single heating source for preparing and providing both domestic hot water and space heating, thereby eliminating the need for maintaining more than one heating source and eliminating the need for space for accommodating more than one heating system.

The present heating system is capable of maintaining fluids at different portions of the system that are fluidly connected, at two different temperatures, thereby enabling the use of only one set of active, fluidly-connected fluid conductors to service both domestic water and space heating demands.

According to one embodiment of the present heating system, domestic water and space heating can be prepared based on forecasted outdoor weather data, thereby eliminating any potential delays associated with drastic drops in outdoor temperature or drastic increase in heat loss to the outdoor environment.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Domestic hot water is typically provided at about 120 degrees F. although it is conceivable that this temperature may be set at a temperature higher or lower than 120 degrees F. by the installer or user of a hot water heater. Space heating fluid supply tube is typically filled with fluid heated to about 180 degrees F. It is also conceivable that this temperature may be set at a temperature higher or lower than 180 degrees F.

Figure 1:
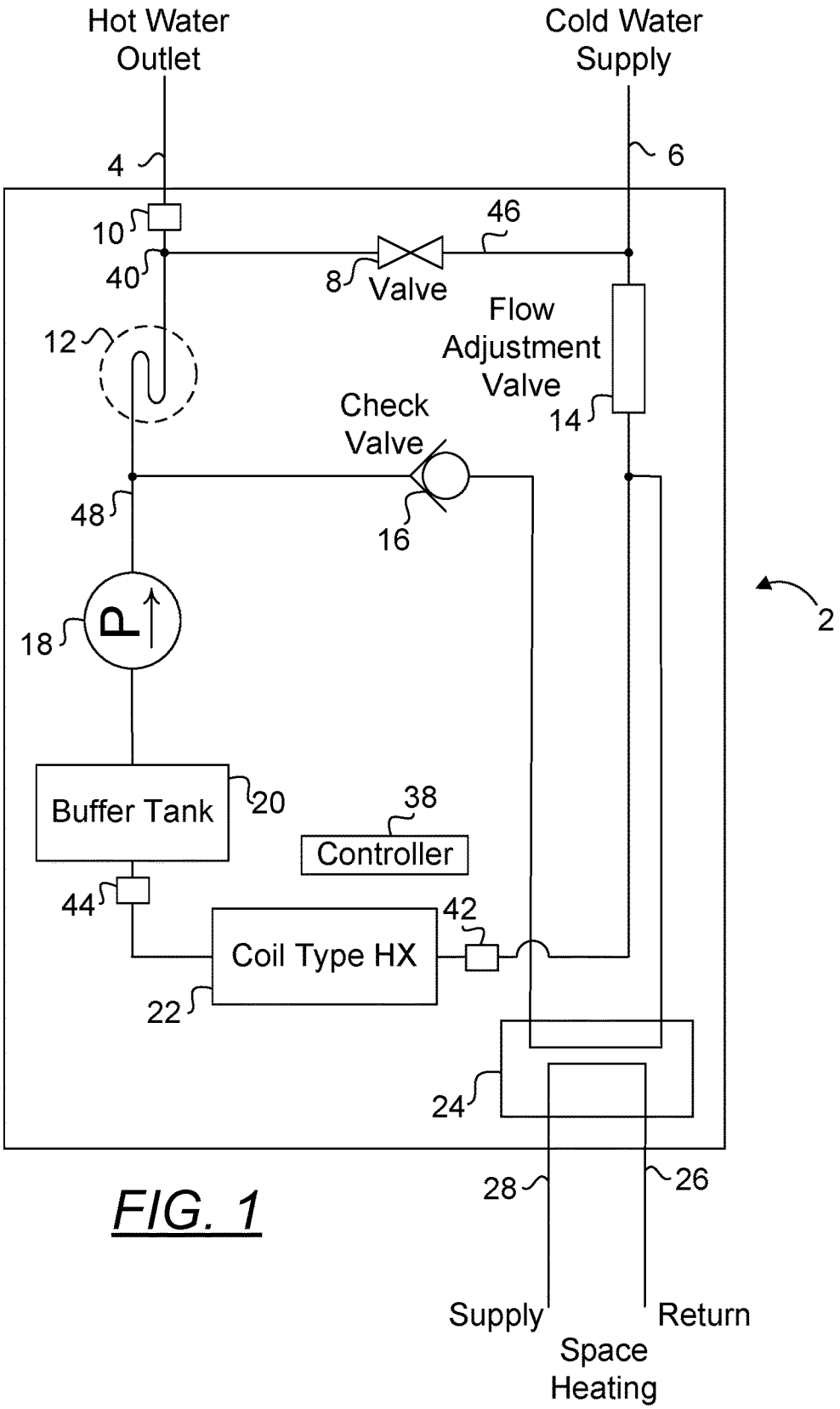
FIG. 1 is a block diagram depicting one embodiment of the present temperature controlled domestic and space heating hot water combination unit.

FIG. 1 is a block diagram depicting one embodiment of the present temperature controlled domestic and space heating hot water combination unit where both the domestic water and space heating loops are active. Instead of using two discrete heating systems, the present embodiment is capable of providing both domestic hot water and hot water for space heating in a single unit. Disclosed herein is a multi-temperature output fluid heating system 2 including an input for receiving a fluid supply, a single heating source functionally coupled with the heat exchanger 22, a first output 48, a second output 4 and a bypass path 46. The first output 48 is fluidly connected to the input 6, where the first output 48 is adapted for control by a first control device 14 and to receive heat from the single heating source to achieve a first temperature at the first output 48. The bypass path 46 fluidly connects the input 6 and the second output 4. In one flow configuration, the input 6 is adapted to empty a first portion of the fluid supply into the first output 48 and a second portion of the fluid supply into the bypass path 46. The second output 4 is adapted to receive an output from the first output 48 and an output from the bypass path 46 to achieve a second temperature. In one example, the first temperature is controlled to about 180 degrees F. In another example, the first temperature is controlled to about 120 degrees F. In one example, the second temperature is controlled to about 120 degrees F. In one embodiment, a controller 38 is provided that is functionally connected to equipment including, but not limited to, valve 8, valve 14, temperature sensors 10, 42, 44, pump 18, heat exchanger 22 and one or more flow meters.

The present system further includes a pump 18 disposed upstream of the first output 48 and configured for pushing an output of the first output 48 through a heat exchanger 24. In one embodiment, the heat exchanger is a plate-type heat exchanger, although another type of heat exchanger may perform equivalent functions of the plate-type heat exchanger. In a plate-type heat exchanger, at least one first flow loop that provides heat is thermally coupled to at least one second flow loop to receive the heat provided by the at least one first flow loop. The at least one second flow loop is functionally connected to a space heating system, e.g., a radiant floor heating system, a baseboard heating system or in-floor heating system, etc., such that the received heat can be rejected into the space being heated.

In one embodiment, the first control device 14 is a modulating device configured to modulate the first portion of the input 6. The modulating device can include, but not limited to, a proportional valve.

In one embodiment, the second portion is adapted for control by a second control device 8. The second control device 8 can include, but not limited to, an on-off valve, e.g., a solenoid valve and a proportional valve. In one embodiment, the second control device is a solenoid valve having a failed state allowing the second portion from the input 6 to the second output 4, thereby ensuring that if the second control device 8 fails, no scalding concerns will exist, as cold water can be supplied through the bypass path 46 to be merged with a potentially acceptably hot first output.

Figure 2:
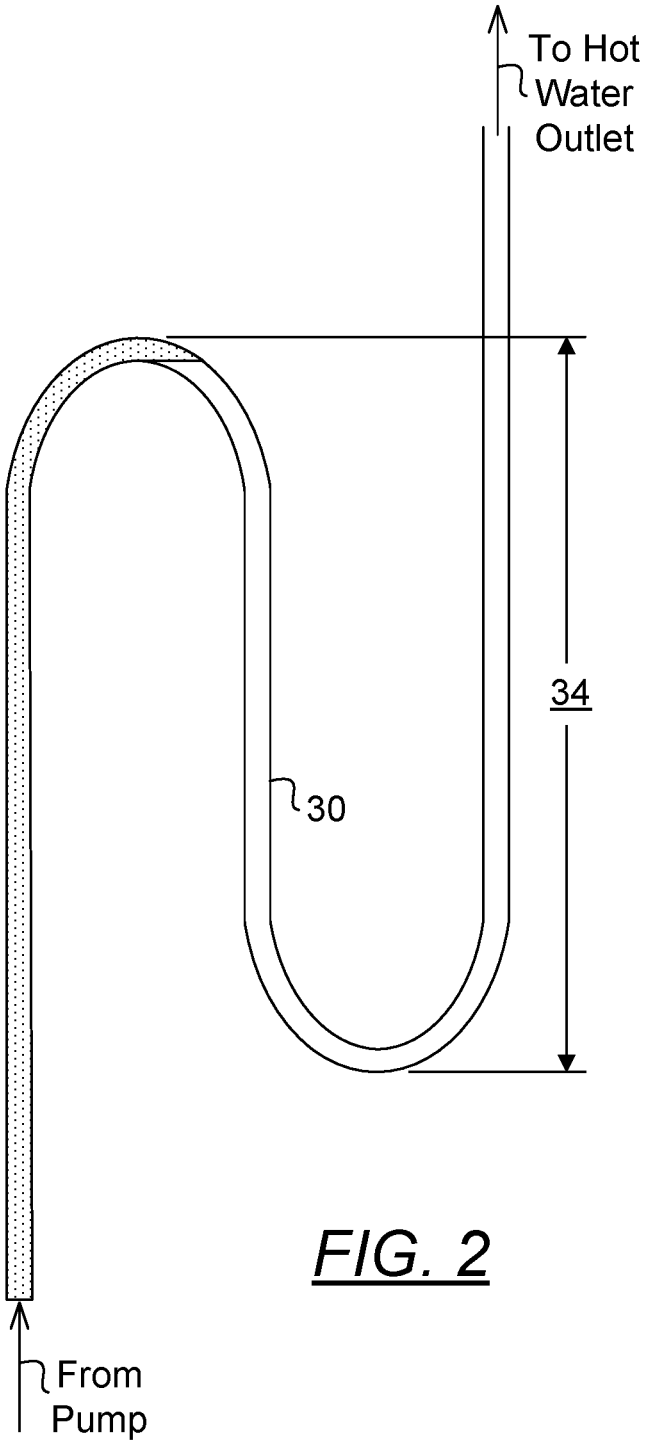
FIG. 2 is a close-up view of one embodiment of the present temperature regulator in the form of an S-shaped bend.
Figure 3:
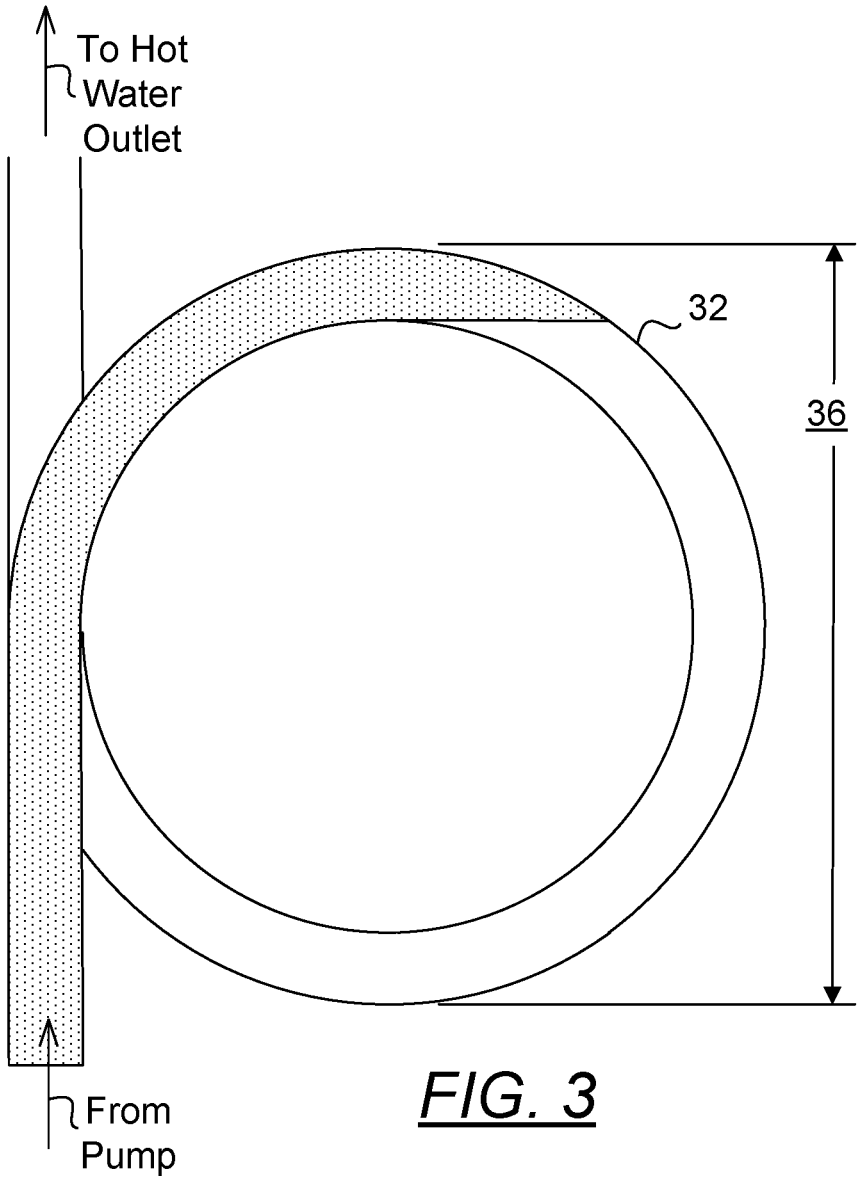
FIG. 3 is a close-up view of another embodiment of the present temperature regulator in the form of a loop.

In one embodiment, the present system further includes a temperature regulator 12 disposed between the second output 4 and the first output 48. The temperature regulator 12 is configured to prevent overheating of the second output 4 if the first output has been maintained for a long period of time at an unacceptably high level and no second output 4 has been the requested during this long period of time and that the second output 4 is mounted at a higher elevation as compared to the first output 48. As shown in FIG. 1, the second output 4 is disposed at a location above that of the first output 48. As such and since warmer water is less dense than cooler water and rises above cooler water, the warmer water tends to rise to the highest point in its path, e.g., in this case, the second output 4 to displace the cooler water already occupying this space. In one embodiment, the temperature regulator is an S-shaped bend 30. If this condition is permitted to occur, when a demand occurs at the second output 4, unsuitably hot water, e.g., at 180 degrees F. or warmer water can exit and contact a user as there is insufficient opportunity for cold water from the input 6 to become mixed with the hot water. However, an S-shaped bend 30 is provided such that the hot water of the first output 48 is trapped in the artificial highest point above the first output 48 (i.e., up to the first change in direction of the S-shaped bend so that the water at the second output 4 can be isolated from the influence of the hot water at the first output 48. FIG. 2 is a close-up view of one embodiment of the present temperature regulator 12 in the form of an S-shaped bend 30 useful in preventing the domestic water loop of the present heating system from receiving unsuitably hot domestic water which is unsuitable for domestic consumption as it is a scalding hazard. The higher temperature water is shown as a shaded portion. In one embodiment, the height 34 of the S-shaped bend is about 4 inches such that it can be contained compactly within a cabinet or enclosure of the present heating system. In another embodiment, the temperature regulator is a loop 32. FIG. 3 is a close-up view of another embodiment of the present temperature regulator in the form of a loop 32. Similar in function to the S-shaped bend disclosed elsewhere herein, the loop prevents the hot water from the first output 48 from reaching the second output 4. The higher temperature water is shown as a shaded portion. In one embodiment, the height 36 of the loop 32 is about 4 inches.

In one embodiment, the present system further includes a buffer tank 20 disposed between the input 6 and the first output 48. The buffer tank 20 serves as a small reservoir of warm water to reduce delays in delivering warm water outputs at their respective first and second temperatures. A temperature sensor 42 is disposed upstream of the heat exchanger 22 while a temperature sensor 44 is disposed downstream from the heat exchanger 22. In some embodiments, the first control device 14 also includes a flow meter capable of determining the water flowrate through the first control device 14. A second flow meter may be used to determine the water flowrate through the bypass path 46. However, in some embodiments, the water flowrate through the bypass path 46 may be inferred given the fluid properties and magnitude of the water flowrate through the bypass path 46. Armed with the temperature difference between readings reported by temperature sensors 42 and 44 and the flowrate of the first output, the heating rate of heat source, e.g., burner, is calculated and adjusted accordingly. If the difference is large and delay in achieving the desired temperature downstream of the heat exchanger is to be minimized, a large heating rate is provided. In one embodiment, the present system further includes a temperature sensor 10 disposed at the second output 4, where the temperature sensor 10 is adapted to detect a condition where the second temperature that is unacceptably high or to report the temperature readings at the second output 4. If the second is unacceptably high, valve 8 is left open and valve 14 closed to provide the maximum flowrate of cold water to get mixed with the unacceptably hot water at juncture 40 such that the temperature of the second output 4 can be tempered. It is also possible that valve 8 and valve 14 can be closed to temporarily stop the flow of the second output 4 and the heating source at the heat exchanger 22 turned off, if the water temperature at temperature sensor 10 is determined to pose severe scalding threat where any amount of cold water provided through the bypass path is considered to be incapable of tempering the hot water already disposed at the second output 4.

Figure 4:
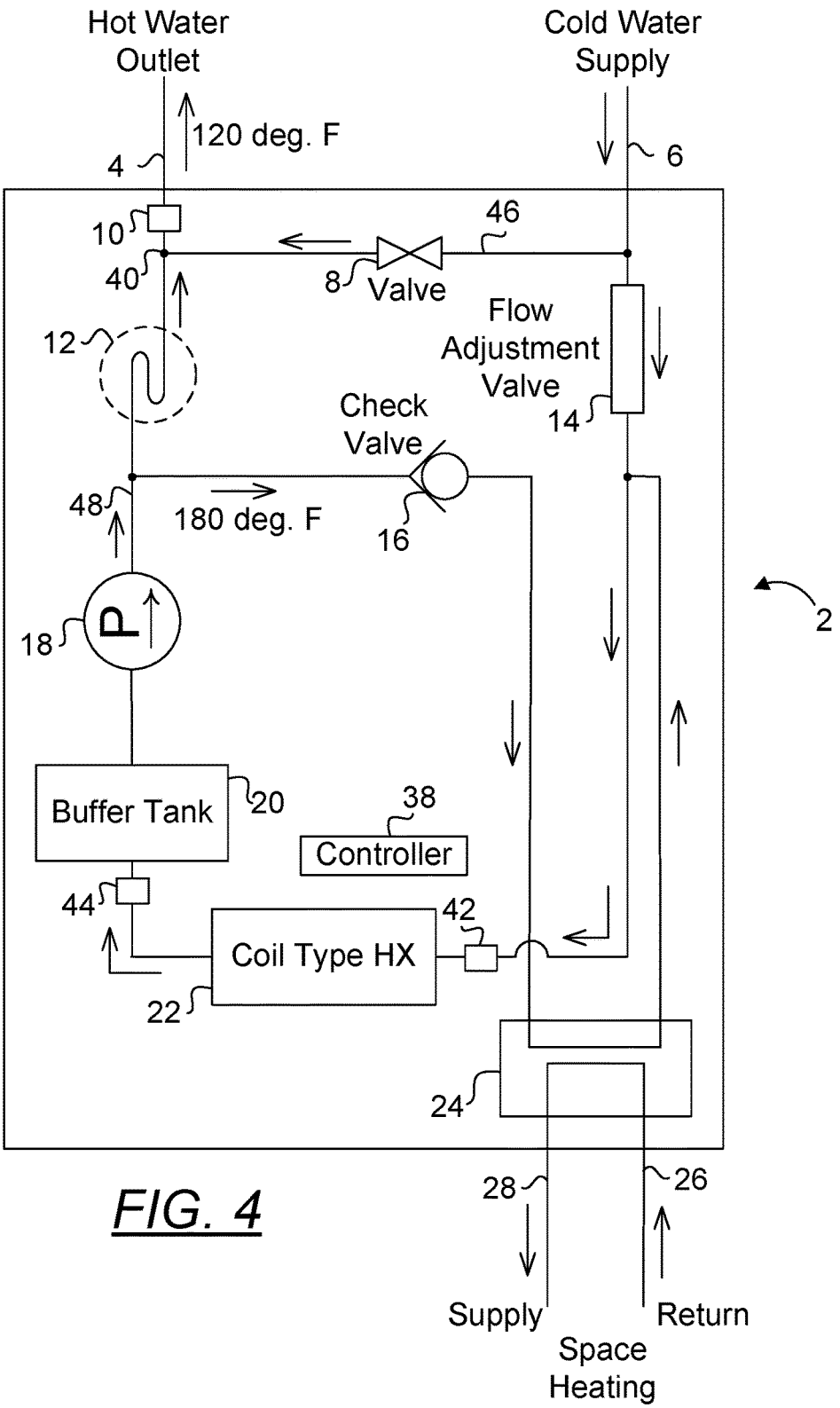
FIG. 4 is a block diagram depicting one embodiment of the present temperature controlled domestic and space heating hot water combination unit where both the domestic water and space heating loops are active.

FIG. 4 is a block diagram depicting one embodiment of the present temperature controlled domestic and space heating hot water combination unit where both the domestic water and space heating loops are active. Many challenges may be faced in configuring a heating system suitable for both domestic hot water and space heating as domestic hot water must be provided at a safe temperature and the domestic hot water is provided at a temperature that is not suitable (lower than required) for space heating. The first output 48 shall be maintained at a temperature significantly higher than the temperature of the second output 4 such that efficient heat transfer (with sufficiently high temperature gradient) can occur at heat exchanger 24. When both domestic hot water and space heating are requested simultaneously, valve 8 is opened to allow cold water to merge with the hot water from the first output 48 such that the 180-degree F. water driven from the pump 18 can be tempered down to a maximum temperature of about 120 degrees F. If valve 8 is capable of modulation, its setting and the setting of valve 14 can be controlled such that the resulting domestic water temperature at the second output 4 as detected at temperature sensor 10 is suitable for domestic use or about 120 degrees F. and the temperature of the water entering heat exchanger 24 is about 180 degrees F. It is also possible that there is a significant travel distance between the second output 4 and the point of use through direct paths or external recirculation circuits. External recirculation circuits may be used in certain circumstances which may alter the water temperature experienced at the point of use. However, such circuits are outside of the scope of the present disclosure. If both domestic water and space heating demand exist, a portion of the input 6 is merged with the heated flow at juncture 40 while another portion is routed through valve 14 to be heated simultaneously. For heat exchanger 24, an external fluid circuit that is not fluidly connected to any flow circuits of the present heating system is routed through areas of a floor or space, where heating is desired. This external circuit enters heat exchanger 24 via return line 26 and exits heat exchanger 24 via supply line 28. In a typical application, an external circuit is anti-freeze filled for freeze protection and suitable heat transfer via heat exchanger 24 to the floor or space it is designed to heat.

Figure 5:
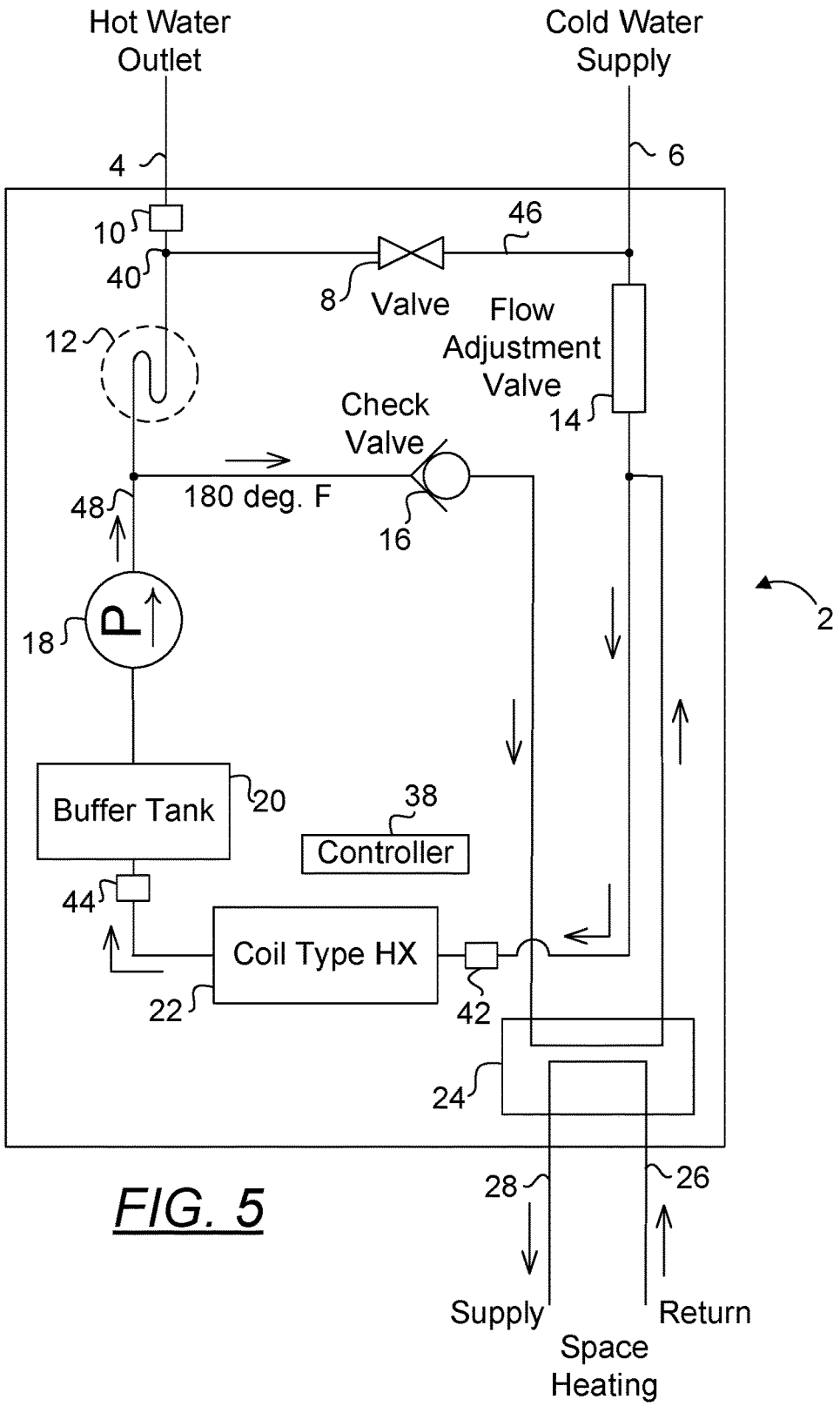
FIG. 5 is a block diagram depicting one embodiment of the present temperature controlled domestic and space heating hot water combination unit where only the space heating loop is active.

Circumstances can exist where an active domestic water demand is no longer needed. FIG. 5 is a block diagram depicting one embodiment of the present temperature controlled domestic and space heating hot water combination unit where only the space heating loop is active. It shall be noted that a flow is only established in the space heating loop. Valve 8 shall be kept open such that if a domestic water demand exists or is requested in the second output 4, at least a portion of the cold water entering via the input 6 can be channeled through the bypass path 46 and be merged with the first output 48 at juncture 40 to temper the hot water at the first output 48 to about 120 degrees F. to avoid scalding concerns. If valve 8 is closed and valve 14 is open and a domestic water demand is requested, the flow entering the input will be drawn in its entirety through valve 14 and continues to be heated in heat exchanger 22. Without a demand at the second output 4, it is also possible to recirculate (by only turning on the pump 18 and turning off the heat exchanger 22) through the domestic water loop via valve 8 and valve 14 if necessary to bring the temperature at the second output 4 to about 120 degrees F. If excessively high temperature is detected at the second output 4, it is possible to leave valves 8, 14 in such settings, the heat exchanger 22 off and the pump 18 on such that excessive heat may be removed from the second output 4. In addition, with sustained flow through both the domestic water and space heating loops, the potential of scale formation is reduced.

Figure 6:
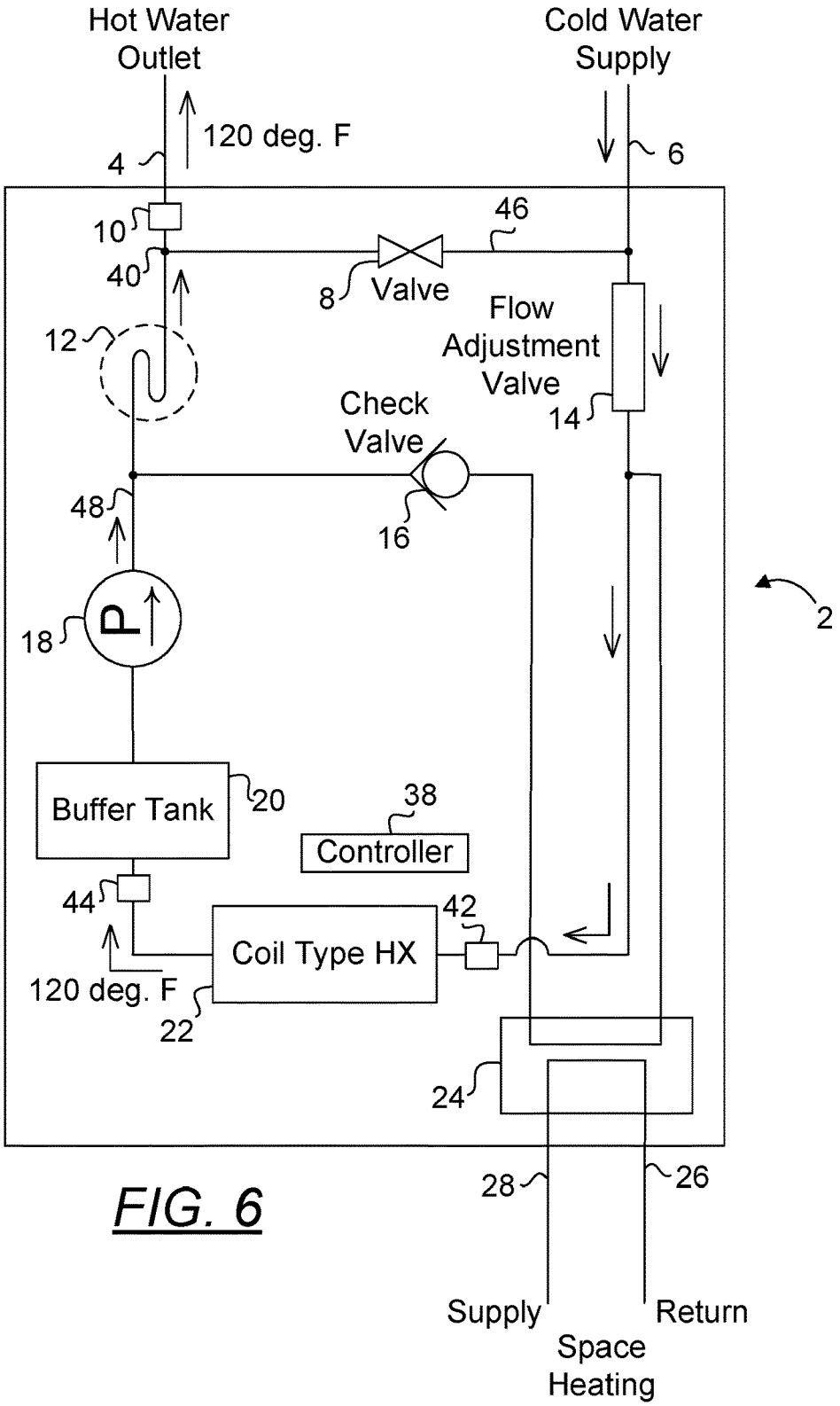
FIG. 6 is a block diagram depicting one embodiment of the present temperature controlled domestic and space heating hot water combination unit where only the domestic hot water loop is active.

Circumstances can exist where an active space heating demand is no longer needed. FIG. 6 is a block diagram depicting one embodiment of the present temperature controlled domestic and space heating hot water combination unit where only the domestic hot water loop is active. If tempering of the first output 48 is deemed unnecessary, e.g., when the space heating demand has ceased and that the first temperature has dropped to a suitable domestic water temperature, valve 8 can be closed but valve 14 will be opened or left open to allow cold water to flow through heat exchanger 22 such that it can be heated to the desired domestic water target temperature as there is now no risk of accidentally providing scalding hot water at the second output 4. Further, if space heating is no longer needed, the pump 18 may be turned off to stop forcing a circulation through heat exchanger 24. In this case, fluid conductors of the present heating system are advantageously sized such that the activation of pump 18 automatically causes circulation through heat exchanger 24. For instance, if 1 Gallon Per Minute (GPM) of domestic water is demanded, the pump 18 that is capable of 4 GPM will cause 1 GPM to exit the first output 48 to continue onto the second output 4 and 3 GPM to exit the first output 48 to continue onto heat exchanger 24. Therefore, without a space heating demand, the pump 18 is turned off once it is no longer needed, causing the flow through heat exchanger 24 to cease while 1 GPM flow to the second output 4 continues. In cases where a space heating demand has just been terminated after having attained the desired temperature for space heating, the pump 18 may be operated for an additional amount of time after the space heating demand has ceased to aid in further drawing and dissipating residual heat from heat exchanger 22. Alternatively, if the pump 18 is kept running when a space heating demand has ceased, a flow through heat exchanger 24 can be terminated by use of a valve just upstream or downstream of check valve 16.

In one embodiment, the controller 38 is configured to set or adjust the target temperatures for domestic water and/or space heating loops based on the frequency of events. The amount of a target temperature adjustment is determined by first monitoring the frequency of heat source turn-on-off, turn-on, or turn-off as called for by a room thermostat and/or the return water temperature as seen in the return line 26 of the space heating loop or a recirculating water flowline within the present heating system. If a room thermostat that is functionally connected to the controller of the present heating system turns on the present heating system frequently, this is an indication that the target temperature of the space heating loop has to be increased in order to keep up with the heat loss rate. A log of the frequency at which the heating source is turned on and the duration at which the heating source is turned on is kept such that the amount of adjustment to the target temperature of the space heating loop can be determined. In determining the amount of adjustment, a monitored parameter is first calculated. This quantity is then compared to a pre-determined threshold. If the quantity exceeds the pre-determined threshold, a difference between the quantity and pre-determined threshold is calculated. The difference is then applied to the target temperature of the heating system to improve the efficiency of the heating system. For example, an excessively high frequency of turn-on-offs, turn-ons or turn-offs of the heating source and/or the lengthy duration of turn-ons of the heating source signals a need to increase the target temperature of the space heating loop as this is an indication that heat loss outweighs the ability of the heating system to meet heating demands. On the other hand, if the fluid temperature of the return line 26 remains high, this may be an indication that the surface area of radiators or baseboards is insufficiently large or efficient to dissipate heat to the floor/s it is configured to heat. In this case, the target temperature for the space heating loop may be adjusted down to avoid overheating the space heating loop.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A method of adjusting the target temperature of a fluid heating system, said method comprising:

(a) obtaining a log of at least one event over a period of time;

(b) calculating a parameter of said at least one event over said period of time from said log;

(c) comparing said parameter to a pre-determined threshold, wherein if said parameter exceeds said pre-determined threshold, a difference between the parameter and said pre-determined threshold is calculated; and (d) applying said difference to the target temperature of the fluid heating system.

2. The method of claim 1, wherein said parameter is frequency.

3. The method of claim 1, wherein the fluid heating system comprises a space heating loop having a supply line and a return line and said parameter is the temperature of the return line.

4. The method of claim 1, said event is selected from the group consisting of turn-on-off of the fluid heating system, turn-on of the fluid heating system, turn-off of the fluid heating system and duration of turn-on of the fluid heating system.

* * * * *